US008833561B2

(12) United States Patent
Samuelson et al.

(10) Patent No.: US 8,833,561 B2
(45) Date of Patent: Sep. 16, 2014

(54) SHRINK BUNDLING PROTECTIVE PACKAGING METHOD AND APPARATUS FOR ELECTRICAL DISTRIBUTION LOAD CENTERS

(71) Applicant: Eaton Corporation, Cleveland, OH (US)

(72) Inventors: Eric Alan Samuelson, Springfield, IL (US); Marc Evan Schoonover, Lincoln, IL (US)

(73) Assignee: Eaton Corporation, Cleveland, OH (US)

( * ) Notice: Subject to any disclaimer, the term of this patent is extended or adjusted under 35 U.S.C. 154(b) by 23 days.

(21) Appl. No.: 13/756,527

(22) Filed: Jan. 31, 2013

(65) Prior Publication Data

US 2014/0183091 A1 Jul. 3, 2014

Related U.S. Application Data

(60) Provisional application No. 61/747,990, filed on Dec. 31, 2012.

(51) Int. Cl.

| | |
|---|---|
| ***B65D 85/00*** | (2006.01) |
| ***B65D 71/08*** | (2006.01) |
| ***B65B 5/04*** | (2006.01) |
| ***B65D 65/22*** | (2006.01) |

(52) U.S. Cl.

CPC .. *B65D 65/22* (2013.01); *B65B 5/04* (2013.01)
USPC ..... 206/722; 53/427; 53/441; 206/497; 206/521

(58) Field of Classification Search

CPC ..... B65D 71/08; B65D 71/10; B65D 71/36; B65D 75/002; B65D 75/004; B65D 81/053; B65D 81/113; H01L 21/67533; H01L 21/67333; B65B 53/02
USPC ..... 206/497, 521, 523, 587–594, 701–726; 53/427, 442, 441
See application file for complete search history.

(56) References Cited

U.S. PATENT DOCUMENTS

| | | | |
|---|---|---|---|
| 4,180,845 | A | 12/1979 | Shariff et al. |
| 4,199,655 | A | 4/1980 | Shariff et al. |
| 4,599,679 | A | 7/1986 | Baader |
| 4,909,554 | A | 3/1990 | Pacione |
| 4,916,574 | A | 4/1990 | Hancock et al. |
| 4,945,188 | A | 7/1990 | Jackson |
| 5,067,043 | A | 11/1991 | Markowski et al. |
| 5,113,312 | A | 5/1992 | Pratt et al. |

(Continued)

FOREIGN PATENT DOCUMENTS

JP 2008162702 A * 7/2008

*Primary Examiner* — Bryon Gehman
(74) *Attorney, Agent, or Firm* — Eckert Seamans Cherin & Mellott, LLC; Kirk D. Houser

(57) ABSTRACT

A device and method for improved electrical distribution load center packaging and shipping is described. The device of the present teachings a distribution load center, a load center trim assembly enclosure, end caps coupled thereto, and shrink wrap applied thereon. Any convenient shrink-wrap processing techniques may be used to practice the present disclosure.

19 Claims, 3 Drawing Sheets

(56) References Cited

U.S. PATENT DOCUMENTS

| | | | | |
|---|---|---|---|---|
| 5,134,543 | A | 7/1992 | Sharp et al. | |
| 5,195,302 | A * | 3/1993 | Collantes et al. | 53/442 |
| 5,242,314 | A | 9/1993 | Di Giulio et al. | |
| 5,924,266 | A * | 7/1999 | Salvador | 53/472 |
| 5,967,329 | A * | 10/1999 | Salvador | 206/723 |
| 6,008,982 | A | 12/1999 | Smith | |
| 6,742,655 | B2 * | 6/2004 | Kasakura | 206/592 |
| 7,824,163 | B2 | 11/2010 | Feick | |

* cited by examiner

SHRINK BUNDLING PROTECTIVE PACKAGING METHOD AND APPARATUS FOR ELECTRICAL DISTRIBUTION LOAD CENTERS

CLAIM OF PRIORITY TO PROVISIONAL APPLICATION

Incorporation by Reference

This application claims priority under 35 USC 119 to U.S. Provisional Application No. 61/747,990, filed Dec. 31, 2012 entitled "SHRINK BUNDLING PROTECTIVE PACKAGING METHOD AND APPARATUS FOR ELECTRICAL DISTRIBUTION LOAD CENTERS"; the contents of Provisional Application No. 61/747,990 filed Dec. 31, 2012 are hereby incorporated herein by reference as if set forth in full.

FIELD

The present disclosure relates generally to packaging of products and apparatus for shipping and handling. More specifically, the present disclosure relates to devices and methods facilitating the packaging and protection of electrical distribution load centers during shipping and handling of same.

BACKGROUND

Electrical distribution load centers are well known in the prior art. These load centers are used, for example, to distribute electricity from a utility source to a building. Load centers usually comprise one or more conductive distribution busses that permit electrical current to be carried throughout a load center. The distribution busses usually contain features permitting for attachment of various branch breakers to conduct electrical distribution electricity to branch circuits.

Manufacturers typically ship load centers to end users in large quantities using wooden pallets adapted for use by forklifts. By shipping one or more distribution load centers next to, above, or beneath each other, the potential for damage exists. Moreover, because pallets are generally stacked upon one another, the combined weight of one or more pallets containing a plurality of distribution load centers further increases the potential for damage. Damage to load centers creates inefficiency in shipping, as damaged products occupy unneeded space on shipping carriers. Damage can also occur when a load center is removed from the pallet load and shipped individually. Damage to load centers also costs money to the manufacturer and shipper, as damaged load centers must be replaced. Damaged load centers create end-user frustration and causes unnecessary shipment delays. Also, if load centers are damaged during shipment, sellers are forced to send replacement load centers in customized non-standard individual packaging at great expense.

The trim assemblies of load centers typically include components permitting attachment or mounting of the load centers to an exterior anchor, such as a wall or electrical box. The trim assembly may include components such as one or more doors, hatches, locks, flanges, or fasteners. Because load centers are often installed in recessed cavities, the trim assemblies may include components that permit installation and mounting of the load center such that the exterior surface of the load center is flush with, or shares the same plane, as the exterior surface to which the load center is mounted. To permit flush mounting of the load centers, the trim assembly components may contain flanges or doors that are larger in size than the load, center. Due to the differences in sizing, packaging and shipping of load centers and their trim assemblies has heretofore been cumbersome and expensive.

In the past, sellers and shippers of electrical distribution load centers have used individual cartons/containers or placed cardboard inserts inside of the load centers to protect the individual load centers from damage during shipment and handling. However, wrapping entire load centers in cardboard creates additional total shipment weight and occupies additional space, further increasing shipment and transportation costs and preventing shippers from maximizing the number of products per pallet.

Shrink wrap technology uses plastic film to package various items. Immediately prior to, during, or after products are configured or prepared for shipment, plastic film is typically heated and applied to the product, causing plastic to shrink over the products and conform closely to the products for shipment. The shrinking up process allows the plastic film to remain in tension over the product to be shipped, preventing the product from further movement during shipment. The use of film that shrinks upon the application of heat distinguishes shrink wrapping from stretch wrapping. Stretch wrapping may use plastic film, but tension is achieved by physically stretching the film around the objects to be shipped.

The tensile strength resulting from the shrink wrapping process often permits for the entire product packaging to be lifted by shrink wrapping alone. Also, when shrink wrapping is applied to an entire parametrical area of a package for shipment without providing any openings, shrink wrapping can produce a substantially air-tight or impermeable package, thereby preventing or reducing exposure and potential damage from external elements and materials. Packaging materials are discarded after the product is installed and the shrink wrap technology allows for improved recycling of materials and reduced overall waste volume compared to typical cardboard packaging. Additionally, clear shrink wrapping can permit shippers, users, and customers to more easily identify products contained within the packaging. Finally, shrink wrapped materials can be preprinted or otherwise display graphics such that labeling and branding can be prominently displayed or under the shrink wrap. However, one of the problems with shrink wrapping is that the tensile force produced can create a non-uniform shape of the shrink-wrapped product assembly or cause products to deflect or deform under the tensile forces created by and during the shrink wrapping process.

Shrink wrapping of individual consumer products is well known. For example, the food and beverage industry uses shrink wrapping to package various items. For example, cheese may be shrink wrapped to prevent mold. Meats and their containers may be shrink wrapped to prevent rot and to permit uniform storage and display. Non-uniform beverage items may be shrink wrapped so that as a combined unit they may be stacked and shipped more efficiently.

When shrink wrapping technology is applied to more than one particular product or item, it is typically referred to as "shrink bundling." By using individual shrink wrapping, larger shrink bundling, or a combination of the two, vendors, shippers, and users can achieve improved shipping efficiency and protection of products while enjoying enhanced product maneuverability and storage capacity.

Despite the fact that shrink wrap technology is commonly known in consumer product packaging applications such as food storage, it is not well known to apply shrink-wrapping technology in the packaging of commercial or industrial products, such as electrical distribution load centers.

Therefore, a need remains for an improved means, method, apparatus, and device that permits for protection of electrical distribution load centers in shipping; that provides for increased efficiency of load center arrangements in shipping; that reduces material disposal needs associated with traditional load center shipping; that prevents the deformation and deflection inherent with shrink wrapping of load centers; that permits for the enhanced viewing, labeling, and branding of electrical load centers during shipping and thereafter; and that facilitates capability of individual shipping of load centers separately from the traditionally used bulk assemblies.

SUMMARY

The present disclosure teaches a device, means, and method for protection of electrical distribution load centers during shipping. One objective of the present disclosure is to provide methods and devices to overcome the shipping protection limitations of the prior art.

One feature of the present disclosure employs shrink wrap technology that ensures that individual load centers are situated and maintained in place so that they are not damaged during shipping. In one embodiment, the shrink wrap film is heated and then applied to the load center packaging assembly. In another embodiment, shrink wrap film is applied to a load center packaging assembly, and thereafter heated. In one embodiment, the shrink wrap is heated simultaneously while being applied to the load center packaging assembly. In another embodiment, shrink wrap film is applied to a load center packaging assembly including a load center trim apparatus. In another embodiment, shrink wrap is applied to a load center packaging assembly including at least one end cap. In another embodiment, shrink wrap is applied to more than one load center packaging assembly, creating a shrink wrap bundle having a plurality of load centers in the packaging assembly. In another embodiment, the shrink wrapping is applied to the entire perimeterical area of a load center packaging without providing any openings, producing a substantially air-tight or sealed package assembly. In one preferred embodiment, shrink wrap is applied to only a substantial portion of the perimeterical area of the load center packaging, permitting openings through which the entire shrink wrapped or shrink bundled load center packaging assembly may be lifted and moved.

In another embodiment, the present disclosure teaches use of shrink wrapping which is entirely clear for easy view of the load center contained in the shrink wrapped packaging. In another embodiment, the present disclosure employs shrink wrapping containing preprinted marketing or other identifying graphics. In one embodiment, the present disclosure teaches using opaque shrink wrapping that can be easily labeled by a marker or other labeling instrument. In yet another embodiment, the present disclosure includes shrink wrap containing both clear and opaque or preprinted portions such that specified portions of the shrink-wrap permit for clear view of the packaged load center product, while other portions may contain marketing graphics or blank areas for use of labeling using a labeling instrument.

The presently disclosed method and apparatus provides for use of a trim assembly enclosure that provides increased structural strength when used in conjunction with end caps, shrink wrapping, or both. In another embodiment, the load center trim assembly components are packed in an enclosure separately from the load center. In another embodiment, said trim assembly enclosure may have two substantially flat surfaces displaced by contents contained therein. In another embodiment, the trim assembly enclosure is stacked in a planar fashion directly above or beneath a load center. In one embodiment, the dimensions of the trim assembly enclosure are larger, both in length and width, than that of the load center. According to this embodiment, the trim assembly effectively defines the structural skeleton of the load center packaging. In one embodiment, the trim assembly enclosure may have anchoring features which permit secure placement of the load center on the trim assembly. In another embodiment, packaged load centers employing the trim assembly enclosure may be stacked upon one another without causing damage because the trim assembly enclosure evenly distributes its weight on the load center upon which it is stacked. In a further alternative embodiment, the lateral edges on the top and bottom sides of the trim assembly enclosure's perimeter are adapted to connect with the structural end-caps.

Another feature of the present disclosure is use of end-caps in load center packaging. In one embodiment, the load center packaging assembly includes one or more end caps located on longitudinal ends of the load center. In one embodiment, the end caps employed in the load center packaging are semi-rigid, further defining the structural skeleton of the individual load center packaging. In one embodiment, the end caps are adapted to connect with the trim assembly enclosure of a packaging of the load center.

Another feature of the presently disclosed invention provides a device, means, and method for increasing space and weight efficiency of load center arrangements for shipping. In one embodiment, the device increases space and weight efficiency in load center packaging using a load center, a load center trim assembly enclosure, end caps coupled onto the longitudinal edges thereof, and shrink wrap then applied thereon. In another embodiment, a method for increasing space and weight efficiency of a load center packaging includes a step of selecting a load center; a step of anchoring the load center to a load center trim assembly enclosure; a step of connecting at least one end cap to at least one of the load center trim assembly enclosure's longitudinal edges; and a step shrink wrapping the load center, trim assembly, and end caps.

Another aspect of the present teachings provide a device, means, and method for reducing waste material disposal requirements associated with traditional load center shipping. In one embodiment, the device for reducing material disposal needs with load center packaging comprises a load center, a load center trim assembly enclosure, end caps connected on the longitudinal edges thereof, and shrink wrap applied thereon. In another embodiment, the method for reducing waste material disposal needs with load center packaging includes a step of selecting a load center, a step of anchoring the load center to the load center trim assembly enclosure, a step of connecting at least one end cap to at least one of the load center trim assembly enclosure's longitudinal edges, and a step of shrink wrapping the load center, trim assembly, and end caps.

Another aspect of the present teachings provides a device, means, and method for preventing deformation and deflection inherent with the application of shrink wrapping to load center packaging. In one embodiment, the device prevents deformation and deflection inherent with the application of shrink wrapping to load center packaging by using an apparatus comprising a load center, a load center trim assembly enclosure, end caps connected on the longitudinal edges thereof, and shrink wrap applied thereon. In another embodiment, a method for preventing deformation and deflection inherent with application of shrink wrapping to load center packaging includes a step of selecting a load center; a step of anchoring the load center to the load center trim assembly enclosure; a step of connecting at least one end cap to at least one of the load center trim assembly enclosure's longitudinal edges; and a step of shrink wrapping the load center, trim assembly, and end caps.

Another aspect of the present teachings provides a device, means, and method for enhanced viewing, labeling, and branding of load center packaging. In one embodiment, the device provides enhanced viewing, labeling and branding of load center packaging. This apparatus comprises a load center, a load center trim assembly enclosure, end caps coupled to the longitudinal edges thereof, and shrink wrap including a clear portion applied thereon. In one embodiment, the device providing for enhanced viewing, labeling and branding of load center packaging comprises a load center, a load center trim assembly enclosure, end caps coupled onto the longitudinal edges thereof, and shrink wrap containing preprinted graphics applied thereon. In one embodiment, the device providing enhanced viewing, labeling and branding of load center packaging comprises a load center, a load center trim assembly enclosure, end caps coupled to the longitudinal edges thereof, and shrink wrap including an opaque portion which may be labeled using a labeling instrument applied thereon. In another preferred embodiment, the method providing for enhanced viewing, labeling and branding of load center packaging includes a step of selecting a load center; a step of anchoring the load center to the load center trim assembly enclosure; a step of connecting at least one end cap to at least one of the load center trim assembly enclosure's longitudinal edges; and a step of shrink wrapping the load center, trim assembly, and end caps with shrink wrapping containing a clear portion permitting view of the shrink-wrapped packaged load center. In another embodiment, the method provides enhanced viewing, labeling and branding of load center packaging including a step of selecting a load center; a step of anchoring the load center to the load center trim assembly enclosure; a step of connecting at least one end cap to at least one of the load center trim assembly enclosure's longitudinal edges; and a step of shrink wrapping the load center, trim assembly, and end caps with shrink wrapping containing graphics. In another embodiment, the method providing for the enhanced viewing, labeling and branding of load center packaging includes a step of selecting a load center; a step of anchoring the load center to the load center trim assembly enclosure; a step of connecting at least one end cap to at least one of the load center trim assembly enclosure's longitudinal edges; and a step shrink wrapping the load center, trim assembly, and end caps with shrink wrapping containing an opaque portion which may be labeled by a labeling instrument applied thereon.

Another aspect of the present disclosure provides a device, means, and method for individually shipping load centers separately from the traditional bulk packaging of load centers. In one embodiment, the device for individual shipping of load centers separately from traditionally used bulk packaging of load centers comprises a load center, a load center trim assembly enclosure, end caps connected on the longitudinal edges thereof, and shrink wrap applied thereon. In another embodiment, the method for individually shipping of load centers separately versus bulk packaging of load centers includes a step of selecting a load center; a step of anchoring the load center to the load center trim assembly enclosure; a step of connecting at least one end cap to at least one of the load center trim assembly enclosure's longitudinal edges; and a step shrink wrapping the load center, trim assembly, and end caps.

Further embodiments of the disclosure are shown in the specification, drawings and claims of the present application.

DETAILED DESCRIPTION

Figure 1:
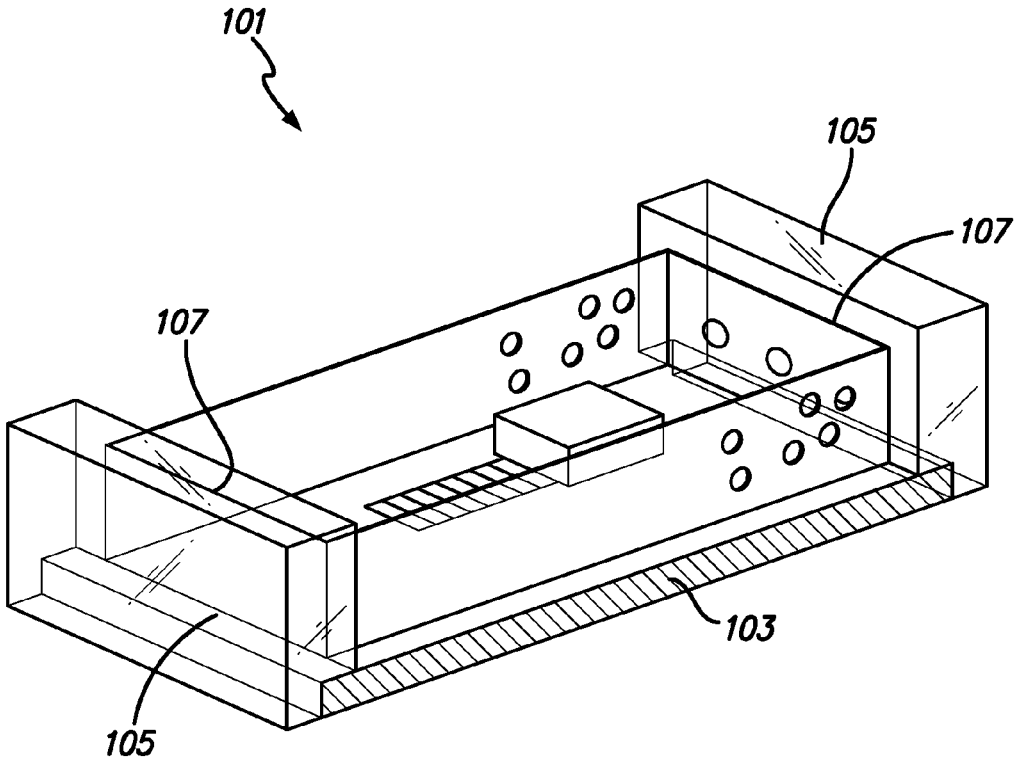
FIG. 1 is a three-dimensional isometric view of an electrical distribution load center shown in packaging prior to application of shrink wrapping, including a distribution load center trim assembly enclosure shown beneath the load center and two end caps located on longitudinal edges of the load center and trim assembly enclosure.

In the present disclosure, a distribution "load center" is defined as a collective of components within an electrical supply system that supply electrical power into one or more subsidiary circuits.

The disclosed teachings provide advantageous devices, systems, and methods for packaging and shipping of electrical load centers and their component parts. The improved load center packaging apparatus described herein provides for protection of the load center from damage during shipping, increased efficiency in space and weight, reduction in shipping material disposal needs, prevention of deformation and deflection inherent with shrink wrapping, processes enhanced viewing, labeling, and branding of electrical load centers packaging, and provision for individual shipping of load centers. As described in more detail below with reference to FIGS. 1-3, the improved load center packaging apparatus provides the foregoing advantages using a load center (101), a load center trim assembly enclosure (103), one or more end caps (105) coupled onto longitudinal edges thereof, and shrink wrapping (109) applied over the entire assembly. The advanced methods described in more detailed below provide the foregoing advantages through the inclusion of a step of selecting a load center (101); a step of placing a trim assembly enclosure (103) above or beneath the load center (101); a step of connecting at least one end cap (105) to at least one of longitudinal edges of the load center trim assembly enclosure (103); and a step of applying shrink wrapping (109) to the load center (101), trim assembly (103), and end caps (105).

FIG. 1 is a three-dimensional isometric view of an electrical distribution load center (101), including a load center trim assembly enclosure (103) shorn beneath the distribution load center (101), and two end caps (105) located at longitudinal edges (107) of the load center (101) and trim assembly enclosure (103). The load center packaging assembly, including the load center (101), the trim assembly enclosure (103), and end caps (105) are shown in FIG. 1 before shrink wrap is applied to the packaging assembly.

Figure 2:
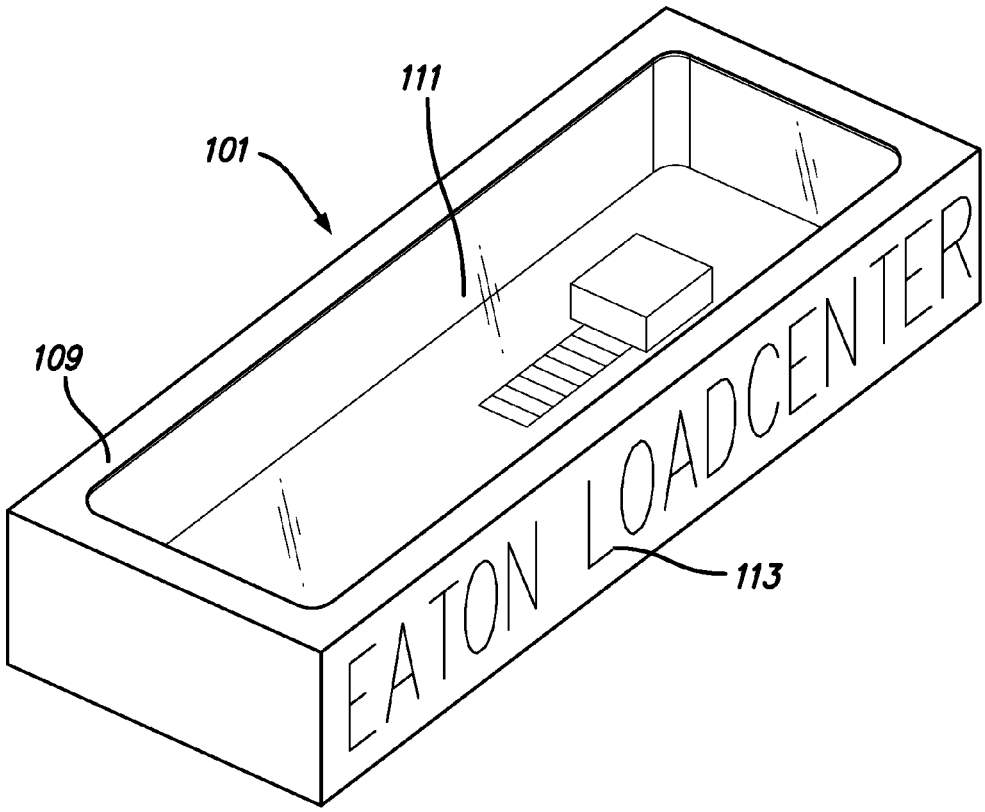
FIG. 2 is a three-dimensional isometric view of the load center of FIG. 1 shown with shrink wrapping applied thereon in accordance with the present teachings.

FIG. 2 is a three-dimensional isometric view of a load center packaging assembly of FIG. 1 after the package assembly is shrink-wrapped in accordance with the present disclosure. As shown in FIG. 2, a shrink wrap or shrink wrapping (109) is applied to the load center packaging assembly. The shrink wrap (109) completely surrounds the load center packaging assembly, including the load center (101), the trim assembly enclosure (103), and end caps (105). The shrink wrapping (109) that is applied to the load center packaging assembly contains both a clear portion (111) that allows a clear view of the load center (101) and as an opaque portion (113).

Figure 3:
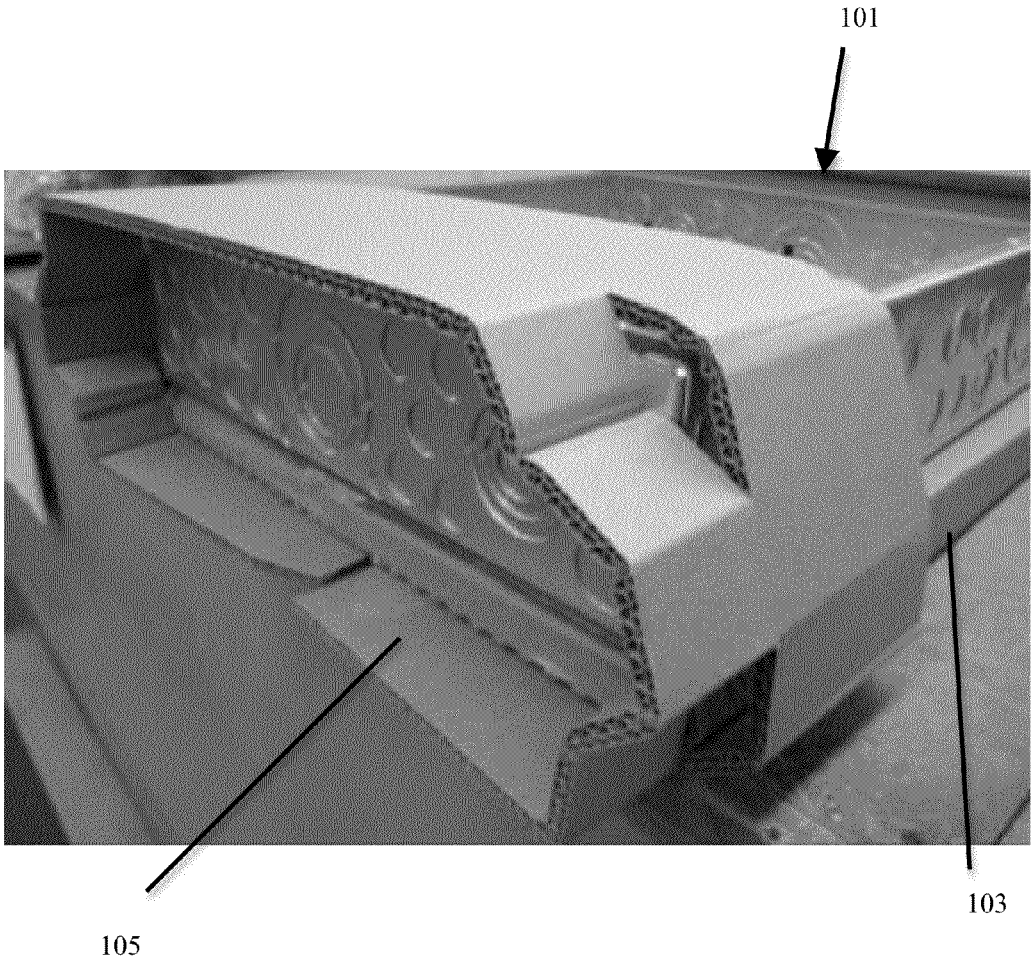
FIG. 3 is a three-dimensional isometric view of a load center shown in shipping packaging prior to the application of shrink wrapping, including a load center trim assembly enclosure shown beneath the distribution load center, and an end cap located on a longitudinal edge of the load center and trim assembly enclosure.

The opaque portion (113) facilitates labeling of the packaging assembly and allows marking/identification information to be placed thereon. FIG. 3 is a three-dimensional isometric view of a load center shown in shipping packaging assembly prior to the application of shrink wrapping in accordance with the present teachings. In FIG. 3, the trim assembly enclosure (103) is made from cardboard. The trim assembly enclosure (103) is wrapped around a load center trim components (not shown in the FIGURES). FIG. 3 depicts a load center packaging assembly using cardboard end caps (105) which have been adapted to receive the longitudinal sides of the distribution load center (101) and to interface with the trim assembly enclosure (103). The components in the packaging assembly depicted in FIG. 3 have been arranged such that the assembly is ready to receive shrink wrapping.

In accordance with the present disclosure, once the distribution load center is properly prepared with shipping packaging such as that shown using the packaging assembly shown in FIG. 3. The entire load center packaging assembly is shrink-wrapped as described above with reference to FIG. 2. As described above in more detail, any convenient and efficient shrink-wrap process can be used to practice the present disclosure. For instance, shrink-wrap film may be heated and applied to cover the entire load center packaging assembly. Alternatively, shrink wrap film may first be applied to the load center packaging assembly and heated thereafter. Heating may be applied simultaneously with application to the assembly.

In view of what is described above, one skilled in the art will understand that the embodiments of the packaging assembly thus far described comprises a load center, a load center trim assembly enclosure, end caps coupled to longitudinal edges thereof, and shrink wrap applied thereon.

What has been shown is an advanced distribution load center packaging assembly. While the load center packaging assembly has been described through specific embodiments and applications thereof, it is understood that numerous modifications and variations could be made thereto by those skilled in the art without departing from the spirit and scope of the disclosure. It is therefore understood that within the scope of the claims, the disclosure may be practiced otherwise than specifically described herein.

Accordingly, it is to be understood that the inventive concept is not to be limited by the specific illustrated embodiments, but only by the scope of the appended claims. The description may provide examples of similar features as are recited in the claims, but it should not be assumed that such similar features are identical to those in the claims unless such identity is essential to comprehend the scope of the claim.

What is claimed is:

1. An electrical distribution load center packaging, comprising:

a first electrical distribution bus load center having a bottom portion and at least two end portions located on opposite longitudinal edge portions of the first load center;

an electrical distribution load center packaging trim assembly enclosure adapted to package the bottom portion of the first load center;

at least two distribution load center packaging end caps adapted to package the end portions of the first load center; and a shrink wrapping applied over a surface of the first electrical distribution bus load center, the distribution load center packaging trim assembly enclosure and the at least two distribution load center packaging end caps, wherein the shrink wrapping envelopes the first electrical distribution bus load center, the trim assembly enclosure and the end caps;

and wherein the shrink wrapping includes a clear portion and an opaque portion.

2. The load center packaging of claim 1, wherein the trim assembly enclosure comprises cardboard sized to mate with the bottom portion of the first load center.

3. The load center packaging of claim 1, wherein the at least two distribution load center packaging end caps comprise cardboard sized to mate with the end portions of the first load center.

4. The load center packaging of claim 1, wherein the opaque portion of the shrink wrapping is adapted to allow written information to be printed or written thereon.

5. The load center packaging of claim 1, wherein the shrink wrapping comprises a relatively thin plastic film that is applied to the first load center, the trim assembly and the end caps such that the plastic film envelopes the first load center, the trim assembly and the end caps, and wherein the relatively thin plastic film is heated thereby causing the plastic film to shrink over the first load center, the trim assembly and the end caps, thereby closely conforming to the shapes of the first load center, the trim assembly and the end caps, and wherein the shrink wrapping creates a tension sufficient to hold the first load center, the trim assembly and the end caps in a relatively fixed position during shipment and handling.

6. The load center packaging of claim 5, wherein the tension created by the shrink wrapping allows the load center packaging to be handled and moved without shifting the relative positions of the first load center, trim assembly and end caps.

7. The load center packaging of claim 5, wherein the shrink wrapping provides an impermeable protective packaging which prevents or reduces damage during shipment or storage.

8. The load center packaging of claim 5, wherein the shrink wrapping is heated while simultaneously being applied to the first load center, the turn assembly and the end caps.

9. The load center packaging of claim 5, wherein the shrink wrapping is heated before it is applied to the first load center, the trim assembly and the end caps.

10. The load center packaging of claim 5, wherein the shrink wrapping is heated after it is applied to the first load center, the trim assembly and the end caps.

11. The load center packaging of claim 1, wherein the shrink wrapping comprises a relatively thin plastic film that is heated and then applied to the first load center, the trim assembly and the end caps such that the relatively thin plastic film completely envelopes the first load center, the trim assembly and the end caps.

12. The load center packaging of claim 1, wherein additional shrink wrapping is applied to a second or more electrical distribution bus load centers thereby securing all of the load centers in a position relative to each other and thereby forming a shrink wrapped bundle comprising a plurality of load centers in packaging assembly for shipment or handling.

13. The load center packaging of claim 1, wherein the shrink wrapping comprises a substantially air-tight package assembly thereby protecting the first load center from damage caused by moisture or other influences during shipment or storage.

14. The load center packaging of claim 1, wherein the shrink wrapping is not substantially air-tight, and wherein the shrink wrapping includes small openings through which access to the first load center can be made, and by which the packaging can be lifted or moved.

15. The load center packaging of claim 1, wherein the clear portion permits viewers to see the contents of the packaging.

16. The load center packaging of claim 1, wherein the opaque portion includes information selected from the group consisting of labeling information, marketing information, graphics and identification information.

17. The load center packaging of claim 1, wherein the trim assembly enclosure includes anchoring features adapted to permit secure placement of the load center or the trim assembly.

18. The load center packaging of claim 1, wherein the end caps are semi-rigid.

19. A method of packaging an electrical distribution load center, comprising:

providing a first electrical distribution bus load center having a bottom portion and at least two end portions located on opposite longitudinal edge portions of the load center;

anchoring the load center to a load center trim assembly enclosure;

coupling the at least two end portions of the electrical distribution bus load center to end caps that are adapted to package the end portions of the first load center; and applying shrink wrapping over a surface of the electrical distribution bus load center, the trim assembly enclosure and the end caps, wherein the shrink wrapping envelopes the first distribution bus load center, the trim assembly enclosure and the end caps;

and wherein the shrink wrapping includes a clear portion and an opaque portion.

* * * * *